US011723126B2

(12) United States Patent
Ayyankotil Kulangara et al.

(10) Patent No.: US 11,723,126 B2
(45) Date of Patent: Aug. 8, 2023

(54) CONTROL MODULE FOR CONTROLLING A LUMINAIRE

(71) Applicant: SIGNIFY HOLDING B.V., Eindhoven (NL)

(72) Inventors: Manoj Ayyankotil Kulangara, Bangalore (IN); Mohammad Yasin, Guntur (IN); Shreyas Venkatesh, Bangalore (IN); Felix Varghese, Thiruvananthapuram (IN); Prashanjit Ghosh, Bangalore (IN)

(73) Assignee: SIGNIFY HOLDING B.V., Eindhoven (NL)

( * ) Notice: Subject to any disclaimer, the term of this patent is extended or adjusted under 35 U.S.C. 154(b) by 126 days.

(21) Appl. No.: 17/416,655

(22) PCT Filed: Dec. 11, 2019

(86) PCT No.: PCT/EP2019/084740
§ 371 (c)(1),
(2) Date: Jun. 21, 2021

(87) PCT Pub. No.: WO2020/126769
PCT Pub. Date: Jun. 25, 2020

(65) Prior Publication Data

US 2022/0046772 A1 Feb. 10, 2022

(30) Foreign Application Priority Data

Dec. 20, 2018 (IN) ..... 201841048473
Feb. 26, 2019 (EP) ..... 19159258

(51) Int. Cl.
*H05B 45/20* (2020.01)

(52) U.S. Cl.
CPC ..... *H05B 45/20* (2020.01)

(58) Field of Classification Search
CPC ..... H05B 45/10; H05B 45/20; H05B 45/30; H05B 45/325; H05B 45/40; H05B 47/11;
(Continued)

(56) References Cited

U.S. PATENT DOCUMENTS 9,237,623 B1 * 1/2016 Lewis ..... H05B 47/19
9,795,000 B1 * 10/2017 Sooch ..... H05B 47/16
(Continued)

FOREIGN PATENT DOCUMENTS

WO 2015188086 A1 12/2015

*Primary Examiner* — Haissa Philogene

(57) ABSTRACT

The invention refers to providing a control module allowing to reduce computational efforts for providing a luminaire with a tunable color temperature. The luminaire (100) comprises two light sources (112, 111), for instance, LEDs, wherein each light source generates white light at a different CCT. The control module comprises a color temperature providing unit (121) providing a desired color temperature, and an assignment providing unit (122) providing an assignment list comprising assignments, wherein each assignment comprises a predefined CCT to which brightness values for each light source are assigned. A brightness value determination unit (123) determines brightness values for the light sources based on the desired color temperature and the assignment list, and a control unit (124) controls the luminaire based on the determined brightness values. The control module allows to reduce the constructional and computational efforts for providing a color temperature tunable luminaire.

11 Claims, 3 Drawing Sheets

(58) Field of Classification Search
CPC .... H05B 47/16; H05B 47/105; H05B 47/155; H05B 47/165; Y02B 20/40
See application file for complete search history.

(56) References Cited

U.S. PATENT DOCUMENTS

| | | | | |
|---|---|---|---|---|
| 2009/0046453 | A1* | 2/2009 | Kramer | F21K 9/00 362/231 |
| 2011/0241552 | A1 | 10/2011 | Ter Weeme et al. | |
| 2017/0265260 | A1 | 9/2017 | Briggs et al. | |
| 2018/0160491 | A1 | 6/2018 | Biery et al. | |
| 2018/0242422 | A1 | 8/2018 | Choi et al. | |

* cited by examiner

CONTROL MODULE FOR CONTROLLING A LUMINAIRE

CROSS-REFERENCE TO PRIOR APPLICATIONS

This application is the U.S. National Phase application under 35 U.S.C. § 371 of International Application No. PCT/EP2019/084740, filed on Dec. 11, 2019, which claims the benefit of European Patent Application No. 19159258.3, filed on Feb. 26, 2019, and Indian Patent Application No. 201841048473, filed on Dec. 20, 2018. These applications are hereby incorporated by reference herein.

FIELD OF THE INVENTION

The invention relates to a control module, a method and a computer program for controlling a luminaire and to a luminaire comprising the control module.

BACKGROUND OF THE INVENTION

In many lighting applications it is desirable that a user can choose a desired color temperature of white light provided by a luminaire. A color temperature is generally defined as the color of light radiated by a black body with the respective temperature. Moreover, if the user indicates a desired color temperature, it is desirable that the luminaire provides light of a color approximating the color of the light generated by a respective black body, i.e. that the luminaire provides a correlated color temperature (CCT). Since the light provided by a black body resembles the light provided by the sun naturally, light provided with a CCT of a desired color temperature appears more natural to a user. Providing a luminaire that allows providing such light is technically very challenging and generally requires the provision of extensive computational resources in connection with the luminaire to calculate the settings of the luminaire that allow to provide a CCT that corresponds to the desired color temperature.

SUMMARY OF THE INVENTION

The present disclosure relates generally to providing a control module, a method, a computer program, and a luminaire comprising the control module that allow to reduce the computational and constructional efforts necessary to provide a luminaire with a tunable color temperature.

In a first aspect of the present invention, a control module for controlling a luminaire comprising a first and a second light source is presented, wherein the first and the second light source are adapted to generate white light at a first and a second CCT, respectively, wherein the light generated by the luminaire is a combination of the light generated by the first and the second light source, wherein the control module comprises a) a color temperature providing unit for providing a desired color temperature, b) an assignment providing unit for providing an assignment list comprising a plurality of assignments, wherein each assignment comprises a predefined CCT to which a first assigned brightness value for the first light source and a second assigned brightness value for the second light source is assigned, and wherein the first and a second assigned brightness value are assigned to the predefined CCT such that the luminaire generates a light with the predefined CCT, when the luminaire is controlled to operate the first and the second light source with the first and second assigned brightness value, respectively, c) a brightness value determination unit for determining a first and a second brightness value for the first and the second light source, respectively, based on the desired color temperature and the assignment list, and d) a control unit for controlling the luminaire such that the first and the second light source of the luminaire are operated to provide light with the first and the second brightness value, respectively.

Since the assignment providing unit provides an assignment list comprising assignments that assign a predefined CCT to a first assigned brightness value for the first light source and a second assigned brightness value for the second light source, and since the brightness value determination unit determines the first and the second brightness value for the first and the second light source based on a desired color temperature and the assignment list, wherein the control unit then controls the luminaire in accordance with the first and the second brightness value, the luminaire can be operated to provide light with a CCT approximating the desired color temperature. Moreover, since the assignment list already provides a plurality of predefined assignments, the computational costs for calculating the first and the second brightness values for providing a light with an approximation of the desired color temperature can be reduced. The constructional and computational efforts for providing a color temperature tunable luminaire can therefore be decreased.

The control module is adapted to control a luminaire comprising two light sources, i.e. a first and a second light source. Preferably, the first and the second light source comprise light emitting diodes (LEDs), or organic light emitting diodes (OLEDs). In particular, the first and the second light source can be any light source providing light with a color temperature that does not vary with the brightness. Moreover, it is preferred that a brightness of each light source can be accurately controlled. The two light sources each generate white light with differing CCTs. Generally, a CCT refers to a temperature of a Planckian radiator, i.e. a black body radiator, whose perceived color most closely resembles that of a given stimulus at the same brightness and under specific viewing conditions. Accordingly, the CCT correlates the white light generated by a light source to a temperature of a black body that radiates light with approximately the same characteristics with respect to a color of the light radiated by the light source. Since the luminaire comprises two light sources that can emit light with different CCTs, by controlling the brightness of the light sources, the color temperature of the luminaire can be tuned. Moreover, the first and the second light source are provided such that the user perceives the light of the luminaire as a combination of the light emitted by the first and the second light source.

The color temperature providing unit is adapted to provide a desired color temperature. The color temperature providing unit can be, for instance, connected to an input providing unit to which a user can directly input a desired color temperature. Moreover, the color temperature providing unit can be connected to a storage unit storing a desired color temperature or a plurality of desired color temperatures. Further, the color temperature providing unit can itself be a storage unit storing a desired color temperature. Generally, the desired color temperature provided by the color temperature providing unit is defined with respect to a black body, wherein the color temperature refers to the temperature of an ideal black body radiator that radiates light of a color corresponding to the desired color.

The assignment providing unit is adapted to provide an assignment list comprising a plurality of assignments. The assignment providing unit can be, for instance, a storage unit for storing the assignment list. Moreover, the assignment providing unit can be connected to a storage unit storing the assignment list and/or can be connected to a unit that is used to determine the assignment list. Preferably, the assignment list is determined during a production stage of the control module and then stored such that the assignment providing unit can provide the assignment list. The assignment list comprises assignments that assign to a plurality of predefined CCTs a respective first and second assigned brightness value, wherein the first and second assigned brightness value is assigned such that when the first and the second light source are controlled to provide light with the first and the second assigned brightness value, respectively, the luminaire generates light with the predefined CCT to which the first and second assigned brightness value are assigned. Preferably, the first and the second assigned brightness value are provided as percentage of the highest brightness value that the respective light source can generate. Alternatively, the brightness values can be provided as absolute brightness values for the respective light source. The assignments of the assignment list can be determined, for instance, during a production stage of the luminaire by measurements, by calculations, and/or simulations of the characteristics of the light sources of the luminaire. Generally, the brightness value of a light source in this application is defined as a luminous flux, i.e. a total amount of energy, provided by the light source operated with the respective brightness value.

The brightness value determination unit is adapted to determine a first and a second brightness value for the first and the second light source, respectively, based on the desired color temperature and the assignment list. Preferably, the brightness value determination unit is adapted to determine the first and the second brightness value such that the luminaire, when operated with the first and the second brightness value, generates light with a color that is indistinguishable for an average user from a CCT corresponding to the desired color temperature. More preferably, the brightness value determination unit is adapted to determine the first and the second brightness value such that the luminaire, when operated with the first and the second brightness value, generates light with coordinates in color space that lie within a MacAdam ellipse around color coordinates of a CCT corresponding to the desired color temperature. For instance, the brightness value determination unit can be adapted to determine the first and the second brightness value based on a mean value, a weighted mean value, or an interpolation between a selection of assigned first and second brightness values, wherein the selected assigned first and second brightness values are interpolated with respect to allowing the luminaire to provide a CCT that approximates the desired color temperature, preferably, that is indistinguishable from a CCT corresponding to the desired color temperature. Moreover, the brightness value determination unit can be adapted to determine a predefined CCT of the assignment list that approximates the desired color temperature, preferably, is indistinguishable from a CCT corresponding to the desired color temperature, and to provide as first and second brightness values the respective assigned first and second brightness values.

The control unit is adapted to control the luminaire. In particular, the control unit is adapted to control the light generated by the first and the second light source of the luminaire, wherein the control unit is adapted to control the first and the second light source such that the first and the second light source provide light with the first and the second brightness value. Since the first and the second light source provide light with the first and the second brightness value, the luminaire generates an overall light with a CCT that approximates the desired color temperature, preferably, is indistinguishable from a CCT corresponding to the desired color temperature, provided by the color temperature providing unit.

In an embodiment, the brightness value determination unit is further adapted to determine nearest predefined CCTs from the predefined CCTs provided in the assignment list, wherein the nearest predefined CCTs correspond to predefined CCTs of the assignment list that have a value nearest to the desired color temperature, wherein the brightness value providing unit is further adapted to determine the first and the second brightness value based on the first and the second assigned brightness values assigned to the nearest predefined CCTs. The brightness value determination unit can be adapted to determine a predefined number of nearest predefined CCTs from the assignment list. Preferably, the brightness value determination unit is adapted to determine two or three nearest predefined brightness values from the assignment list. Preferably, determining the nearest predefined CCTs comprises determining a nearest predefined CCT list that sorts all predefined CCTs of the assignment list based on a difference between each predefined CCT and the desired color temperature. The predefined CCTs with smallest differences can then be selected. In particular, when a specific number of nearest predefined CCTs is predefined, for instance, two, three or four nearest predefined CCTs, then the respective nearest predefined CCTs can be determined as the predefined CCTs corresponding to the respective smallest difference values. For example, if it is predefined that three nearest predefined CCTs are to be determined, the nearest predefined CCTs are determined as the predefined CCTs corresponding to the predefined CCT with the smallest difference, the second smallest difference and the third smallest difference. If more or less nearest predetermined CCTs are to be determined, they can be determined accordingly.

Additionally or alternatively, the brightness value determination unit can be adapted to determine the nearest predefined CCTs based on a color temperature interval. The color temperature interval is defined such that all CCT values being greater than a first threshold and being smaller than a second threshold fall within the color temperature interval, wherein the first threshold is smaller than the second threshold. Preferably, the brightness value determination unit is adapted to determine the color temperature interval such that it is centered around the desired color temperature, for instance, by adding and subtracting a predetermined color temperature to the desired color temperature to determine the first and second threshold of the color temperature interval. The brightness value determination unit can then be adapted to determine all predefined CCTs of the assignment list lying within the color temperature interval as nearest predefined CCTs.

Additionally or alternatively, the brightness value determination unit can be adapted to determine the nearest predefined CCTs based on a sorted assignment list, wherein in the sorted assignment list the assignments are sorted based on their predefined CCT. Preferably, the sorted assignment list comprises assignments that are sorted with respect to an ascending or descending order of the predefined CCTs. The brightness value determination unit can then be adapted to determine a fictive position of the desired color temperature in the sorted assignment list and to determine as nearest predefined CCTs predefined CCTs of the sorted assignment list that lie in a neighborhood of the desired color temperature.

The brightness value providing unit is then adapted to determine the first and the second brightness value based on the first and the second assigned brightness values assigned to the determined nearest predefined CCTs. For instance, the brightness value providing unit can be adapted to provide as first and second brightness value a mean first and second brightness value of all first and second brightness values assigned to the nearest predefined CCTs, respectively. Preferably, the brightness value determination unit is adapted to determine the first and the second brightness value based on an interpolation function interpolating the first and the second brightness values in dependence on a color temperature, wherein the brightness value determination unit is adapted to determine the interpolation function based of the nearest predefined CCTs and the first and second assigned brightness values assigned to the nearest predefined CCTs. For instance, the interpolation function can be determined based on a linear interpolation, quadratic interpolation or any higher order interpolation, depending on the number of determined nearest predefined CCTs. The brightness value determination unit can then be adapted to determine the first and the second brightness value by calculating a position of a CCT corresponding to the desired color temperature on the interpolation function provided by the interpolation between the first and the second assigned brightness values assigned to the nearest predefined CCTs.

In a preferred embodiment, the brightness value determination unit is adapted to determine as interpolation function a function linearly interpolating the first and second assigned brightness values assigned to the nearest predefined CCTs over the nearest predefined CCTs. More preferably, the brightness value determination unit is adapted to determine as interpolation function a function linearly interpolating a first nearest predefined CCT and a second nearest predefined CCT, wherein the first nearest predefined CCT corresponds to the nearest predefined CCT that is smaller than the desired color temperature, and wherein the second nearest predefined CCT corresponds to the nearest predefined CCT that is larger than the desired color temperature. Preferably, the brightness value determination unit is adapted to determine the first nearest predefined CCT by determining at least two nearest predefined CCTs, wherein at least one of the predefined CCTs is smaller than the desired color temperature, wherein the brightness value determination unit is then adapted to choose as first nearest predefined CCT the nearest predefined CCT that is nearest to the desired color temperature with respect to all nearest predefined CCTs being smaller than the desired color temperature. Moreover, the brightness value determination unit is preferably adapted to determine the second nearest predefined CCT by determining at least two nearest predefined CCTs, wherein at least one of the predefined CCTs is larger than the desired color temperature, wherein the brightness value determination unit is then adapted to choose as second nearest predefined CCT the nearest predefined CCT that is nearest to the desired color temperature with respect to all nearest predefined CCTs being larger than the desired color temperature. The brightness value determination unit is then adapted to determine the interpolation function by linearly interpolating between the first and the second assigned brightness values of the first and the second nearest predefined CCTs.

In an embodiment, the brightness value determination unit is adapted to determine a nearest predefined CCT of the assignment list that corresponds to the predefined CCT that is nearest to the desired color temperature and to determine as first and second brightness value for the first and the second light source the first and second assigned brightness value that are assigned to the nearest predefined CCT. For instance, the brightness value determination unit is adapted to determine as nearest predefined CCT the predefined CCT of the assignment list that comprises the smallest difference between the desired color temperature and the predefined CCT with respect to all other predefined CCTs. The brightness value determination unit is then adapted to determine as the first and second brightness values the first and second assigned brightness values of the nearest predefined CCT. Preferably, in this embodiment, the assignment list comprises a full range assignment list, wherein a full range assignment list corresponds to providing the assignment list with predefined CCTs between the CCTs provided by the first and the second light source such that always at least two arbitrary neighboring predefined CCTs of the assignment list are indistinguishable by an average user when the assignment list is sorted with respect to descending or ascending CCTs. More preferably, the full range assignment list corresponds to providing the assignment list such that always at least two arbitrary neighboring predefined CCTs of the assignment list comprise color coordinates that lie within a MacAdam ellipse of each other, when the assignment list is sorted with respect to descending or ascending CCTs. Alternatively, the assignment list can be a full range assignment list if the assignment list comprises an assignment for each integer CCT between the CCT of the first light source and the CCT of the second light source.

In an embodiment, the controlling of the first and the second light source comprises determining a first and a second power that is necessary for operating the first and the second light source such that they provide light with the first and the second brightness value and to operate the first and the second light source with the first and the second power, respectively. In particular, the controlling unit is adapted to control the electric power supply to the first and the second light source, wherein the electric power supply to the first and the second light source determines the brightness of the first and the second light source. Preferably, the determining of the first and the second power necessary for operating the first and the second light source with the first and the second brightness value is based on known efficacy values of the first and the second light source. The efficacy value refers to a ratio between the luminous flux, i.e. brightness value, and a power consumption of a light source. Generally, the efficacy value can be predetermined, for instance, by measurements for each light source.

In an embodiment, the assignment providing unit is adapted to provide the assignments of the assignment list based on predefined and/or measured characteristics of the luminaire. Preferably, during a production stage of the luminaire, characteristics of the first and the second light source of the luminaire are predefined or measured, wherein the predefined or measured characteristics are provided to the assignment providing unit. The assignment providing unit can then be adapted, for instance, to provide the assignments of the assignment list by selecting one of a plurality of predetermined assignment lists based on the predefined and/or measured characteristics of the luminaire. For instance, assignment lists for a plurality of characteristics of the first and the second light source can be predetermined by measurements or simulations and provided to the assignment providing unit before the delivery of the luminaire. Preferably, the characteristics comprise at least a measured CCT of the first and the second light source of the luminaire. Additionally, the characteristics can comprise, for instance, a known development of a CCT of the first and the second light source with time, for instance, per lighting hour, if it is known that the first and the second light source change their CCT characteristic during the usage of the luminaire.

In an embodiment, the color temperature providing unit is adapted to further provide a desired dim level corresponding to a desired overall brightness value of the light provided by the luminaire, wherein the brightness value determination unit is adapted to determine the first and second brightness value further on the desired dim level. Preferably, the dim level is provided as percentage of a largest brightness value that can be provided by the luminaire. Alternatively, the desired dim level can be provided as absolute brightness value for the light of the luminaire. The brightness value determination unit is then adapted to determine the first and the second brightness value further on the desired dim level, in particular such that the luminaire, when operated in accordance to the first and the second brightness value, provides a light with a desired dim level. In a preferred embodiment, the brightness value determination unit is adapted to determine first and second temporary brightness values based on the desired color temperature and the assignment list, wherein if the luminaire is controlled such that the first and the second light source are operated with the first and second temporary brightness values, the luminaire provides light with the largest possible brightness, and to determine the first and the second brightness value by interpolating the first and second temporary brightness value to the desired dim level. In particular, the linear interpolation of the first and the second temporary brightness value to the first and the second brightness value corresponds to a scaling of the first and the second temporary brightness values in accordance with the dim level. For instance, if the dim level refers to 50% of the largest possible brightness value of light provided by the luminaire, the first and second brightness values can be determined by dividing the first and the second temporary brightness values by half. Alternatively, the assignment list provided by the assignment providing unit can further comprise assignments for different dim levels, wherein the brightness value determination unit can then be used to interpolate the assignments provided by the assignment list to determine first and second brightness values that allow the luminaire to provide light with a desired dim level.

In a further aspect of the present invention a luminaire is presented, wherein the luminaire comprises a) a first and a second light source, wherein the first and the second light source are adapted to generate white light at a first and a second CCT, respectively, wherein the light generated by the luminaire is a combination of the light generated by the first and the second light source, and b) a control module for controlling the luminaire according to the above embodiments.

In a further aspect of the present invention a method for controlling a luminaire comprising a first and a second light source is presented, wherein the first and the second light source are adapted to generate white light at a first and a second CCT, respectively, wherein the light generated by the luminaire is a combination of the light generated by the first and the second light source, wherein the method comprises the steps of a) providing a desired color temperature, b) providing an assignment list comprising a plurality of assignments, wherein each assignment comprises a predefined CCT to which a first assigned brightness value for the first light source and a second assigned brightness value for the second light source is assigned, and wherein the first and the second assigned brightness value are assigned to the predefined CCT such that the luminaire generates a light with the predefined CCT, when the luminaire is controlled to operate the first and the second light source with the first and second assigned brightness value, respectively, c) determining a first and a second brightness value for the first and the second light source, respectively, based on the desired color temperature and the assignment list, and d) controlling the luminaire such that the first and the second light source of the luminaire are operated to provide light with the first and the second brightness value, respectively.

In a further aspect, a computer program for controlling a luminaire comprising a first and a second light source is presented, wherein the computer program comprises program code means for causing the control module defined above to carry out the steps of the method as defined above when the computer program is executed by the control module. Further a logical circuitry can be provided comprising the computer program or being adapted to execute the steps of the method defined above.

It shall be understood that the system, the luminaire, the method, and the computer program, all respectively defined above, have similar and/or identical preferred embodiments.

It shall be understood that a preferred embodiment of the present invention can also be any combination of the elements defined above.

These and other aspects of the invention will be apparent from and elucidated with reference to the embodiments described hereafter.

DETAILED DESCRIPTION OF EMBODIMENTS

Figure 1:
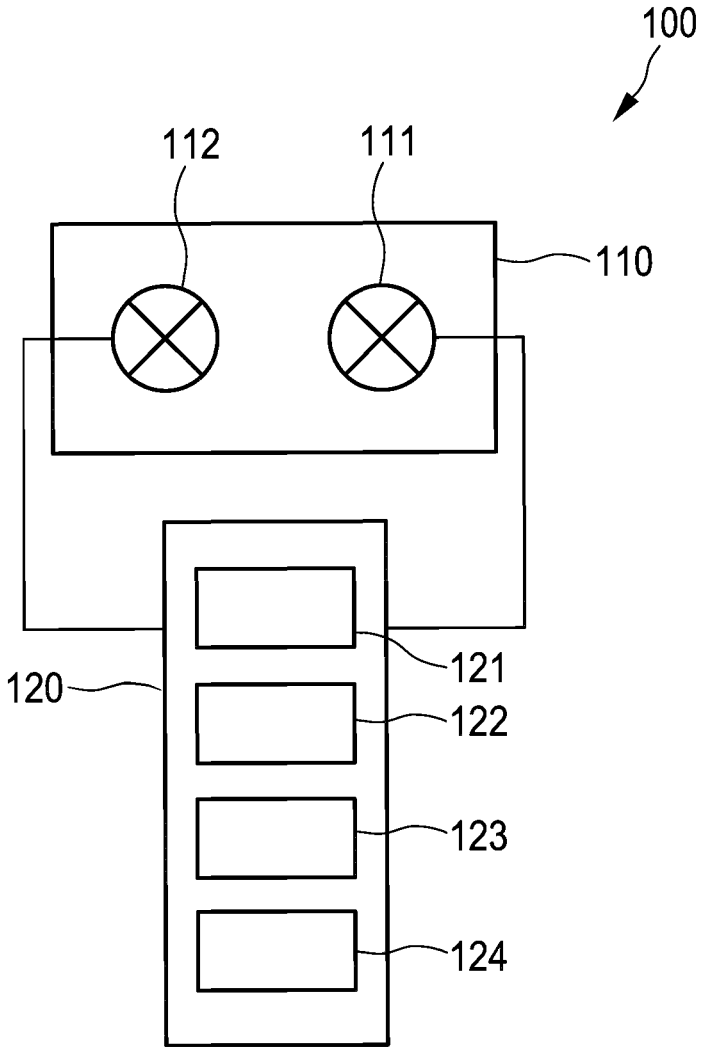
FIG. 1 shows schematically and exemplarily an embodiment of a luminaire in accordance with the present invention.

FIG. 1 shows schematically and exemplarily an embodiment of a luminaire in accordance with the present invention. In this embodiment, the luminaire 100 comprises a first light source 111 and a second light source 112 arranged within a luminaire housing 110. The luminaire 100 is adapted such that the light provided by the first light source 111 and the second light source 112 is combined to provide the overall light of the luminaire 100. Preferably, the first and the second light source 111, 112 are provided as LEDs. The first light source 111 provides white light with a first CCT and the second light source 112 provides white light with a second CCT. For the following description it is assumed that the first light source 111 provides warm white light with a color temperature of 2700 K and the second light source 112 provides cold white light with a CCT of 6500 K. Accordingly, the luminaire 100 is adapted to provide light with CCTs in a range between 2700 K and 6500 K.

The luminaire 100 comprises a control module 120 for controlling the first and the second light source 111, 112 and thus for controlling the luminaire 100. The control module 120 comprises a color temperature providing unit 121, an assignment providing unit 122, a brightness value determination unit 123 and a control unit 124.

The color temperature providing unit 121 is adapted to provide a desired color temperature. In particular, in this embodiment the color temperature providing unit 121 is connected to an input unit, not shown in FIG. 1, into which a user can input a desired color temperature. A desired color temperature generally refers to the temperature of a black body radiating light with the desired color. The luminaire 100 comprising the light source 111 and 112 can only provide light that refers to a combination of the light of the first and the second light source 111, 112, wherein the light provided by the first and second light source 111, 112 does not necessarily refer to light as generated by a black body. Instead, the luminaire 100 should be controlled by the control module 120 such that it provides light with a CCT that approximates the desired color temperature, preferably, that is indistinguishable from a CCT corresponding to the desired color temperature.

For achieving this goal, the assignment providing unit 122 provides an assignment list. In this embodiment the assignment providing unit 122 corresponds to a storage unit storing a predetermined assignment list, for instance, an assignment list that has been determined and stored before the delivery of the luminaire 100. The assignment list comprises a plurality of assignments, wherein each assignment refers to a combination of a predefined CCT and a first assigned brightness value for the first light source 111 and second assigned brightness value for the second light source 112. During the determination of the assignments list the assignments are determined such that the luminaire 100 provides light with the predefined CCT, when the first light source 111 is operated with the first assigned brightness value and the second light source 112 is operated with the second assigned brightness value.

The brightness value determination unit 123 is adapted to determine a first and a second brightness value for the first and the second light source 111, 112 based on the desired color temperature and the assignment list. Preferably, the brightness value determination unit 123 is adapted to determine the first and the second brightness value such that the light provided by the luminaire 100 comprises a color temperature that approximates the desired color temperature as closely as possible, preferably, that is indistinguishable for an average user from a CCT corresponding to the desired color temperature. In the following, an embodiment of determination of the first and the second brightness values will be explained in more detail with respect to FIG. 2.

Figure 2:
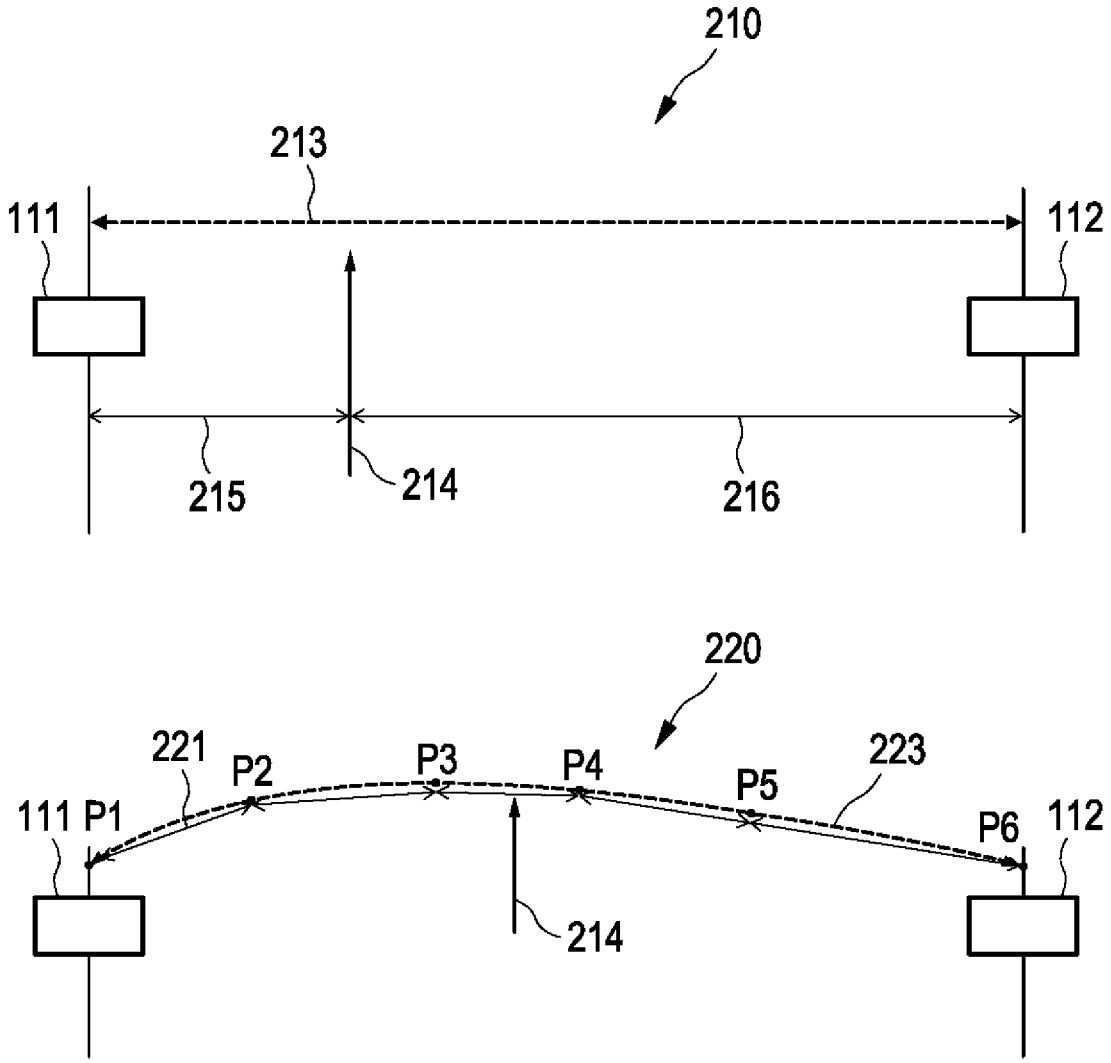
FIG. 2 shows schematic drawings for illustrating a function of an exemplary embodiment of the invention.

In a first example 210 shown in FIG. 2 it is assumed that the assignment list only comprises two assignments, wherein the first assignment comprises the CCT provided by the first light source 111, schematically illustrated as box 111, and the second assignment corresponds to the CCT of the second light source 112, schematically illustrated as box 112. The first assignment further comprises a first assigned brightness value of 100% of a maximum brightness value that can be provided by the first light source 111 and a second assigned brightness value of 0% of a maximum brightness value that can be provided by the second light source 112. The second assignment comprises accordingly a first assigned brightness value of 0% and a second assigned brightness value of 100%. In this example, the desired color temperature 214 that should be provided by the luminaire 100 is determined by a linear interpolation between the first and the second assignment of the assignment list with respect to the desired color temperature 214 indicated in FIG. 2 with an arrow. The linear color temperature course is indicated by an arrow 213. Further, in FIG. 2 an arrow 215 refers to the difference between the desired color temperature 214 and the CCT of the first light source 111 being a warm light source and an arrow 216 corresponds to the difference between the desired color temperature 214 and the CCT of the second light source 112 being a cold light source. In accordance with the example, the brightness value determination unit 123 can be adapted to determine a brightness value for the first and the second light source 111, 112 in accordance with the following method. Firstly, the brightness value determination unit 123 can be adapted to calculate a first light source ratio WR by $$WR = \frac{(TC - TR)}{\Delta T},$$

wherein TC refers to a CCT of the second light source, TR refers to the desired color temperature 214, and ΔT refers to the difference between the CCT of the second light source 112 and the CCT of the first light source 111. Accordingly, a second light source ratio CR can be calculated by $$CR = \frac{(TR - TW)}{\Delta T},$$

wherein TW refers to the CCT of the first light source. The brightness value determination unit 123 is then adapted to determine the first and the second brightness values CB and WB based on the first and second light source ratio CR and WR, for instance, by multiplying the first and second light source ratio CR and WR with a given overall brightness of the luminaire, with 100%, etc.

Further, a desired dim level of the luminaire 100 can be provided by the color temperature providing unit 121, wherein the desired dim level refers in this example to a desired overall brightness value BR of the luminaire 100. In this case brightness value determination unit 123 can be adapted to determine the first and the second brightness values WB and CB according to:

$$CB = BR \times CR,$$

$$WB = BR \times WR$$

Following this exemplary calculation, a first and a second brightness value WB and CB can be provided that allows the luminaire 100 to provide light with a color temperature approximating the desired color temperature 214. But, since the CCTs that correlate to black body temperatures are not equidistantly distributed over the color temperature range of the luminaire 100, the approximated color temperature provided by a linear interpolation as shown above will not necessarily correspond to a CCT of the desired color temperature 214 and most likely will only be a rough estimate of the desired color temperature 214. Therefore, it is preferred that the assignment list comprises more than two assignments as shown schematically in the drawing 220 of FIG. 2.

In the drawing 220 of FIG. 2 the non-linear distribution of the CCT values is indicated by curved line 223. Further, the assignments provided by the assignment lists for this example are indicated as P1, P2, P3, P4, P5 and P6 on curve 223. For a better understanding, the assignments for the points P1 to P6 are exemplarily provided in the following table.

| PRESET | Predefined CCT | First assigned brightness value | Second assigned brightness value |
|---|---|---|---|
| P1 | 2700K | 100% | 0% |
| P2 | 3000K | 89% | 11% |

-continued

| PRESET | Predefined CCT | First assigned brightness value | Second assigned brightness value |
|---|---|---|---|
| P3 | 3500K | 69% | 30% |
| P4 | 4000K | 52% | 48% |
| P5 | 5000K | 28% | 71% |
| P6 | 6500K | 0% | 100% |

The assignment list, for instance, the assignment list exemplarily shown in the above table, is preferably determined in the context of a production of the luminaire 100. For instance, a luminaire with the same specifications as the luminaire 100 can be used to measure CCTs of the luminaire for different first and second brightness values and to provide the assignment list then based on the measured CCTs of the different first and second brightness values. Alternatively, the assignment list might be calculated based on a known specification, i.e. characteristics, of the luminaire 100. For instance, if the CCTs of the first and the second light source 111, 112 are known, the first and the second brightness values for a plurality of CCTs between the CCT of the first and the second light source 111, 112 can be calculated in accordance with known color temperature calculations.

To allow the luminaire 100 to generate light with the color temperature that better estimates a CCT corresponding to the desired color temperature 214, the first and the second brightness values can be calculated by the brightness value determination unit 123 by linearly interpolating between the provided assignments of the assignment list, for example, by determining an interpolation function that interpolates the first and the second brightness values and predefined CCTs of at least two nearest predefined CCTs. The linear interpolation between the provided assignments P1 to P6, respectively, is indicated in the drawing 220 by arrows 221.

For example, for the desired color temperature 214 indicated in drawing 220 the brightness value determination unit 123 can be adapted to determine a first nearest predefined CCT value and a second nearest predefined CCT value. The first nearest predefined CCT value of assignment P3 corresponds to a predefined CCT of the assignment list being smaller than the desired color temperature 214 and providing the smallest difference between the desired color temperature 214 and all predefined CCT being smaller than the desired color temperature 214. The second nearest predefined CCT of assignment P4 can be determined by the brightness value determination unit 123 as a predefined CCT of all predefined CCTs with a value being larger than the desired color temperature 214 and having the smallest difference to the desired color temperature 214 from all predefined CCTs being larger than the desired color temperature 214. A first and a second brightness value can then be determined by the brightness value determination unit 123 for the desired color temperature 214 by linearly interpolating in the same way as explained above with respect to the drawing 210 between the first nearest predefined CCT of assignment P3 and the second nearest predefined CCT of assignment P4 of the assignment list. For this embodiment a luminaire 100 operated with the first and the second brightness value will provide light with a color temperature approximating the desired color temperature more accurately. Preferably, the accuracy of the interpolation is increased by increasing the number of predefined CCTs provided by the assignment list and/or by determining a higher order interpolation function based on determined nearest predefined CCTs and to determine the first and second brightness value based on the higher order interpolation function. It is preferred that the brightness value determination unit 123 is adapted to interpolate the first and second brightness values such that the light of the luminaire 100 provided while operating the luminaire 100 with the first and second brightness value is indistinguishable for an average user from light with a CCT corresponding to the desired color temperature.

The control unit 124 is then adapted to control the luminaire 100 by operating the first and the second light source 111, 112 with the first and the second brightness value determined by the brightness value determination unit 123. For operating the first and the second light source 111, 112 with the first and the second brightness value, the control unit 124 can be adapted to determine a respective power that has to be provided to the first and the second light source 111, 112 such that the first and the second light source 111, 112 provide light with the first and the second brightness value, respectively.

Figure 3:
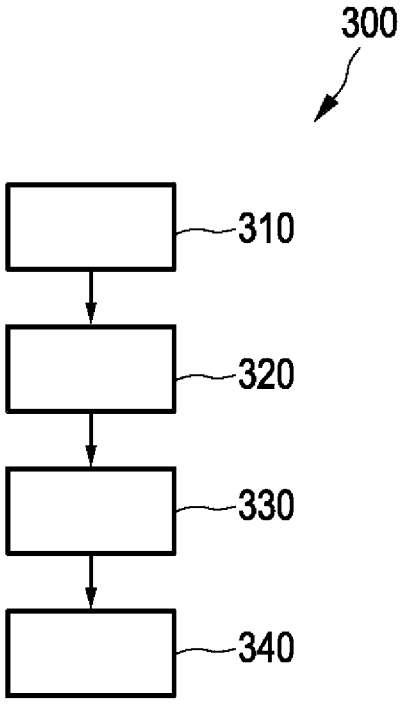
FIG. 3 shows a flowchart exemplarily illustrating an embodiment of a method for controlling a luminaire in accordance with the present invention.

FIG. 3 shows a flowchart exemplarily illustrating an embodiment of a method for controlling a luminaire 100 in accordance with the present invention. The method 300 comprises a first step 310 of providing a desired color temperature 214. In a second step 320 further an assignment list is provided, wherein the assignment list comprises a plurality of assignments as described above. In a third step 330 a first and a second brightness value are determined for the first and the second light source 111, 112, respectively, based on the desired color temperature 214 and the assignment list, wherein the first and the second brightness value are determined, for instance, in accordance with the above described methods. Moreover, in a last step 340 the luminaire 100, in particular the first and the second light source, is controlled to provide light with the first and the second brightness value.

Although in the above embodiments a desired color temperature is directly provided by a user to the color temperature providing unit, in other embodiments a desired color temperature can be provided, for instance, by a lightning control system controlling the lighting settings of a plurality of luminaires, or a desired color temperature can be stored in the color temperature providing unit and provided under circumstances that are also stored in the color temperature providing unit, for instance, with respect to certain day or night times.

Although in the above embodiments the assignment list comprises assignments between predefined CCTs and first and second assigned brightness values, in other embodiments the assignment list can further comprise assignments between predefined CCTs, first and second assigned brightness values and a dim level corresponding to an overall brightness of the light generated by the luminaire. In such an embodiment the color temperature providing unit can be adapted to further provide a desired dim level, wherein the brightness value determination unit is then adapted to determine the first and the second brightness value based on the assignment list comprising assignments for different dim levels.

Although in the above embodiments the brightness value determination unit is adapted to determine the first and the second brightness value based on linear interpolations between the assignments of the assignment list, in other embodiments the brightness value determination unit can be adapted to determine the first and the second brightness value based on higher order interpolations. For instance, in such a case the brightness value determination unit can be adapted to provide more than two nearest predefined CCTs and to interpolate the first and the second brightness value based on the first and the second assigned brightness values of the more than two nearest CCTs. Alternatively, the brightness value determination unit can be adapted to determine only one nearest predefined CCT in the assignment list being the CCT with the value nearest to the desired color temperature, wherein the brightness value determination unit can then be adapted to determine the first and second assigned brightness values of the nearest predefined CCT as the first and second brightness values. In such an embodiment it is preferred that the assignment list refers to a full range assignment list, wherein the full range assignment list provides assignments such that always at least two arbitrary neighboring predefined CCTs of the assignment list comprise color coordinates that lie within a MacAdam ellipse of each other, when the assignment list is sorted with respect to descending or ascending CCTs.

Other variations to the disclosed embodiments can be understood and effected by those skilled in the art in practicing the claimed invention, from the study of the drawings, the disclosure, and the appended claims.

In the claims, the word "comprising" does not exclude other elements or steps, and the indefinite article "a" or "an" does not exclude a plurality.

A single unit or device may fulfill the functions of several items to be cited in the claims. The mere fact that certain measures are recited in mutually different dependent claims does not indicate that a combination of these measures cannot be used to advantage.

Procedures like the determining of a first and a second brightness value or the controlling of the luminaire, performed by one or several units or devices can be performed by any other number of units or devices. These procedures and/or the operations of the system can be implemented as program code means of a computer program and/or as dedicated hardware.

A computer program may be stored/distributed on a suitable medium, such as an optical storage medium or a solid-state storage medium, supplied together with or as part of other hardware, but may also be distributed in other forms, such as via the Internet or other wired or wireless communication systems.

Any reference signs in the claims should not be construed as limiting the scope.

The presented invention refers to providing a control module allowing to reduce computational efforts for providing a luminaire with a tunable color temperature. The luminaire comprises two light sources, for instance, LEDs, wherein each light source generates white light at a different CCT. The control module comprises a color temperature providing unit providing a desired color temperature, and an assignment providing unit providing an assignment list comprising assignments, wherein each assignment comprises a predefined CCT to which brightness values for each light source are assigned. A brightness value determination unit determines brightness values for the light sources based on the desired color temperature and the assignment list, and a control unit controls the luminaire based on the determined brightness values. The control module allows to reduce the constructional and computational efforts for providing a color temperature tunable luminaire.

The invention claimed is:

1. A control module for controlling a luminaire, comprising a first and a second light source, wherein the first and the second light sources are adapted to generate white light at a first and a second correlated color temperature (CCT), respectively, wherein the light generated by the luminaire is a combination of the light generated by the first and the second light sources, wherein the control module comprises:

a color temperature providing unit for providing a desired color temperature, an assignment providing unit for providing an assignment list comprising a plurality of assignments, wherein each assignment comprises a predefined CCT to which a first assigned brightness value for the first light source and a second assigned brightness value for the second light source are assigned, and wherein the first and the second assigned brightness values are assigned to the predefined CCT such that the luminaire generates a light with the predefined CCT when the luminaire is controlled to operate the first and the second light sources with the first and second assigned brightness values, respectively, a brightness value determination unit for determining a first and a second brightness value for the first and the second light sources, respectively, based on an interpolation function interpolating the first and the second brightness values in dependency of a CCT, wherein the brightness value determination unit is adapted to determine the interpolation function based on nearest predefined CCTs from the predefined CCTs provided in the assignment list, wherein the nearest predefined CCTs correspond to predefined CCTs of the assignment list that have a value nearest to the desired color temperature, and a control unit for controlling the luminaire such that the first and the second light sources of the luminaire are operated to provide light with the first and the second brightness values, respectively.

2. The control module according to claim 1, wherein the brightness value determination unit is adapted to determine as interpolation function a function linearly interpolating the nearest predefined CCTs and the first and second assigned brightness values assigned to the nearest predefined CCTs.

3. The control module according to claim 2, wherein the brightness value determination unit is adapted to determine as interpolation function a function linearly interpolating a first nearest predefined CCT and a second nearest predefined CCT, wherein the first nearest predefined CCT corresponds to the nearest predefined CCT that is smaller than the desired color temperature, and wherein the second nearest predefined CCT corresponds to the nearest predefined CCT that is larger than the desired color temperature.

4. The control module according to claim 1, wherein the first and the second light sources are controlled to determine a first and a second power that are necessary for operating the first and the second light sources such that they provide light with the first and the second brightness values and for operating the first and the second light sources with the first and the second powers, respectively.

5. The control module according to claim 4, wherein the control unit is adapted to determine the first and the second powers based on known efficacy values of the first and the second light sources.

6. The control module according to claim 1, wherein assignment providing unit is adapted to provide the assignments of the assignment list based on predefined and/or measured characteristics of the luminaire.

7. The control module according to claim 6, wherein the characteristics comprise at least a measured CCT of the first and the second light sources of the luminaire.

8. The control module according to claim 1, wherein color temperature providing unit is adapted to further provide a desired dim level corresponding to a desired overall brightness value of the light provided by the luminaire, wherein the brightness value determination unit is further adapted to determine the first and second brightness values further on the desired dim level.

9. The control module according to claim 8, wherein the brightness value determination unit is adapted to determine first and second temporary brightness values based on the desired color temperature and the assignment list, wherein if the luminaire is controlled such that the first and the second light sources are operated with the first and second temporary brightness values the luminaire provides light with the largest possible brightness value, and to determine the first and the second brightness value by interpolating the first and second temporary brightness values to the desired dim level.

10. A luminaire comprising:

a first and a second light source, wherein the first and the second light sources, are adapted to generate white light at a first and a second CCT, respectively, wherein the light generated by the luminaire is a combination of the light generated by the first and the second light sources, and a control module for controlling the luminaire according to claim 1.

11. A method for controlling a luminaire comprising a first and a second light source, wherein the first and the second light sources are adapted to generate white light at a first and a second CCT, respectively, wherein the light generated by the luminaire is a combination of the light generated by the first and the second light sources, wherein the method comprises the steps of:

providing a desired color temperature, providing an assignment list comprising a plurality of assignments, wherein each assignment comprises a predefined CCT to which a first assigned brightness value for the first light source and a second assigned brightness value for the second light source are assigned, and wherein the first and the second assigned brightness values are assigned to the predefined CCT such that the luminaire generates a light with the predefined CCT when the luminaire is controlled to operate the first and the second light sources with the first and second assigned brightness values, respectively, determining a first and a second brightness value for the first and the second light sources, respectively, based on an interpolation function interpolating the first and the second brightness values in dependency of a CCT, wherein the brightness value determination unit is adapted to determine the interpolation function based on nearest predefined CCTs from the predefined CCTs provided in the assignment list, wherein the nearest predefined CCTs correspond to predefined CCTs of the assignment list that have a value nearest to the desired color temperature, and controlling the luminaire such that the first and the second light sources of the luminaire are operated to provide light with the first and the second brightness values, respectively.

* * * * *